United States Patent [19]

Sonnabend

[11] 4,354,415

[45] Oct. 19, 1982

[54] PHASE-MODULATING SYSTEM FOR ELECTRONIC MUSICAL INSTRUMENTS

[75] Inventor: Werner Sonnabend, Trossingen, Fed. Rep. of Germany

[73] Assignee: Matth. Hohner AG, Trossingen, Fed. Rep. of Germany

[21] Appl. No.: 218,815

[22] Filed: Dec. 22, 1980

[30] Foreign Application Priority Data

Dec. 22, 1979 [DE] Fed. Rep. of Germany ..... 2952113

[51] Int. Cl.[3] ..... G10H 1/043

[52] U.S. Cl. ..... 84/1.24; 84/1.25; 84/DIG. 4; 179/1 J

[58] Field of Search ..... 84/1.24, 1.25, DIG. 4, 84/DIG. 26; 179/1 J; 333/165

[56] References Cited

U.S. PATENT DOCUMENTS

| | | | |
|---|---|---|---|
| 3,257,495 | 6/1966 | Williams | 84/1.25 |
| 3,418,418 | 12/1968 | Wilder | 84/1.25 |
| 3,644,657 | 2/1972 | Miller | 84/1.25 |
| 3,699,233 | 10/1972 | Suzuki | 84/1.24 X |
| 3,833,752 | 9/1974 | Van Der Kooij | 84/1.24 |
| 3,866,505 | 2/1975 | Adachi | 84/1.24 |
| 3,978,755 | 9/1976 | Woron | 84/1.24 |
| 3,979,991 | 9/1976 | Kawamoto | 84/1.25 |
| 4,043,243 | 8/1977 | Peterson | 84/1.25 |
| 4,080,861 | 3/1978 | Wholahan | 84/1.24 |
| 4,144,790 | 3/1979 | Suchoff | 84/1.25 |
| 4,186,643 | 2/1980 | Nishibe et al. | 84/1.24 |

FOREIGN PATENT DOCUMENTS

| | | |
|---|---|---|
| 1925946 | 1/1970 | Fed. Rep. of Germany . |
| 2309321 | 9/1973 | Fed. Rep. of Germany . |
| 2523881 | 12/1975 | Fed. Rep. of Germany . |

OTHER PUBLICATIONS

Verzogerung von Nf-Signalen mit MOS-Eimerketten by Hollman et al., pp. 967-970, 1009, & 1010.

*Primary Examiner*—Stanley J. Witkowski
*Attorney, Agent, or Firm*—Karl F. Ross

[57] ABSTRACT

An electronic musical instrument comprises a sound generator connected to a loudspeaker by way of several parallel channels including respective delay lines constituted by charge-transfer devices of the bucket-brigade type stepped by different high-frequency pulse generators. Each pulse generator comprises a voltage-controlled oscillator whose output frequency is varied by a composite periodic signal obtained from a respective stage of a chain of operational amplifiers each provided, except possibly for the first stage, with an RC network acting as a frequency-dependent phase shifter for a nonsinusoidal modulating signal consisting of at least two sub-audio-frequency components. The modulating signal may be synthesized from a plurality of stepped waveforms generated by the concurrent readout, at different sampling rates, of a set of amplitude values stored in a read-only memory.

10 Claims, 3 Drawing Figures

(Fig. 1)

LOW-FREQUENCY OSCILLATOR
LOW-FREQUENCY OSCILLATOR
+V
+V

PHASE-MODULATING SYSTEM FOR ELECTRONIC MUSICAL INSTRUMENTS

FIELD OF THE INVENTION

My present invention relates to a phase-modulating system for an electronic musical instrument, designed to simulate the effect of a chorus or ensemble. Systems of this type have become known in the art as string-chorus circuits.

BACKGROUND OF THE INVENTION

It has long been recognized that an electronic generator of musical sounds cannot, by itself, duplicate the acoustic effect of, say, a string orchestra or a pipe organ from which nominally identical notes are perceived by the ear of a listener with slight time-varying phase differences. Thus, U.S. Pat. No. 3,257,495 (Williams) describes a system in which two oscillators of different frequencies in the sub-audio range, specifically of 6 and 13 Hz, modulate an audio signal in the output of an electronic organ to create a complex vibrato effect. U.S. Pat. No. 3,833,752 (Van der Kooij) teaches the use of three signal channels connected in parallel to an electronic-organ output, these channels including respective delay lines of the charge-transfer type controlled by gating-pulse trains from generators responsive to a modulating signal synthesized from two sub-audio-frequency oscillations, specifically of about 1 and 5 Hz, which pass through separate phase shifters designed to introduce predetermined phase differences between the three modulating signals. The insertion of individual modulators in such parallel signal channels, in lieu of controllable delay lines, is known from U.S. Pat. No. 3,979,991 (Kawamoto).

OBJECT OF THE INVENTION

The object of my present invention is to provide a structurally simple phase-modulating system for the purpose set forth which further enhances the acoustic impression of random phase variations to impart a still more natural character, simulating an ensemble such as a string orchestra, to electronically generated music.

SUMMARY OF THE INVENTION

The basic structure of the present system, generally similar to that of the aforementioned Van der Kooij patent, includes a plurality of parallel channels connecting a source of audio-frequency oscillations, specifically an electronic synthesizer of musical sounds, to electroacoustic transducer means such as one or more loudspeakers. Each channel comprises a charge-transfer chain stepped by a respective high-frequency pulse generator which is connected to modulating means designed to subject the audio-frequency oscillations to delays varying at sub-audible rates.

In accordance with my present improvement, the modulating means connected to the several pulse generators comprises waveform-generating means for producing a composite periodic signal, synthesized by additive combination from at least two sub-audio-frequency components, and transmission means with a plurality of junction points separated by common phase-shifting means for converting this composite signal into respective control signals with different relative phasing of its components, the junction points being connected to respective frequency-adjusting inputs of the associated pulse generators for supplying the control signals thereto. Thus, the composite signal traverses a single transmission path along which its components undergo different phase shifts in passing from one junction point to the next; additional frequency-dependent phase shifts can be introduced in the connections between these junction points and the corresponding pulse-generator inputs.

More particularly, I prefer to provide in that common transmission path a plurality of cascaded operational amplifiers whose outputs are connected to the respective junction points, the phase-shifting means being constituted at least in part by a plurality of frequency-dependent circuits, such as RC networks, respectively connected to some or all of these amplifiers. Further operational amplifiers, with resistive/capacitive feedback circuits also forming part of the phase-shifting means, may be included in the connections between the junction points and the pulse-generator inputs.

The components of the composite periodic signal, which in itself is of nonsinusoidal character, may be sine, stepped or square waves produced by fixed-frequency oscillators or multivibrators, for example. They could also be obtained from a data store such as a read-only memory containing a set of digitized amplitudes of a desired waveform read out at different rates by two or more scanning circuits operating at nonidentical speeds.

BRIEF DESCRIPTION OF THE DRAWING

The above and other features of my invention will now be described in detail with reference to the accompanying drawing in which.

SPECIFIC DESCRIPTION

Figure 1:
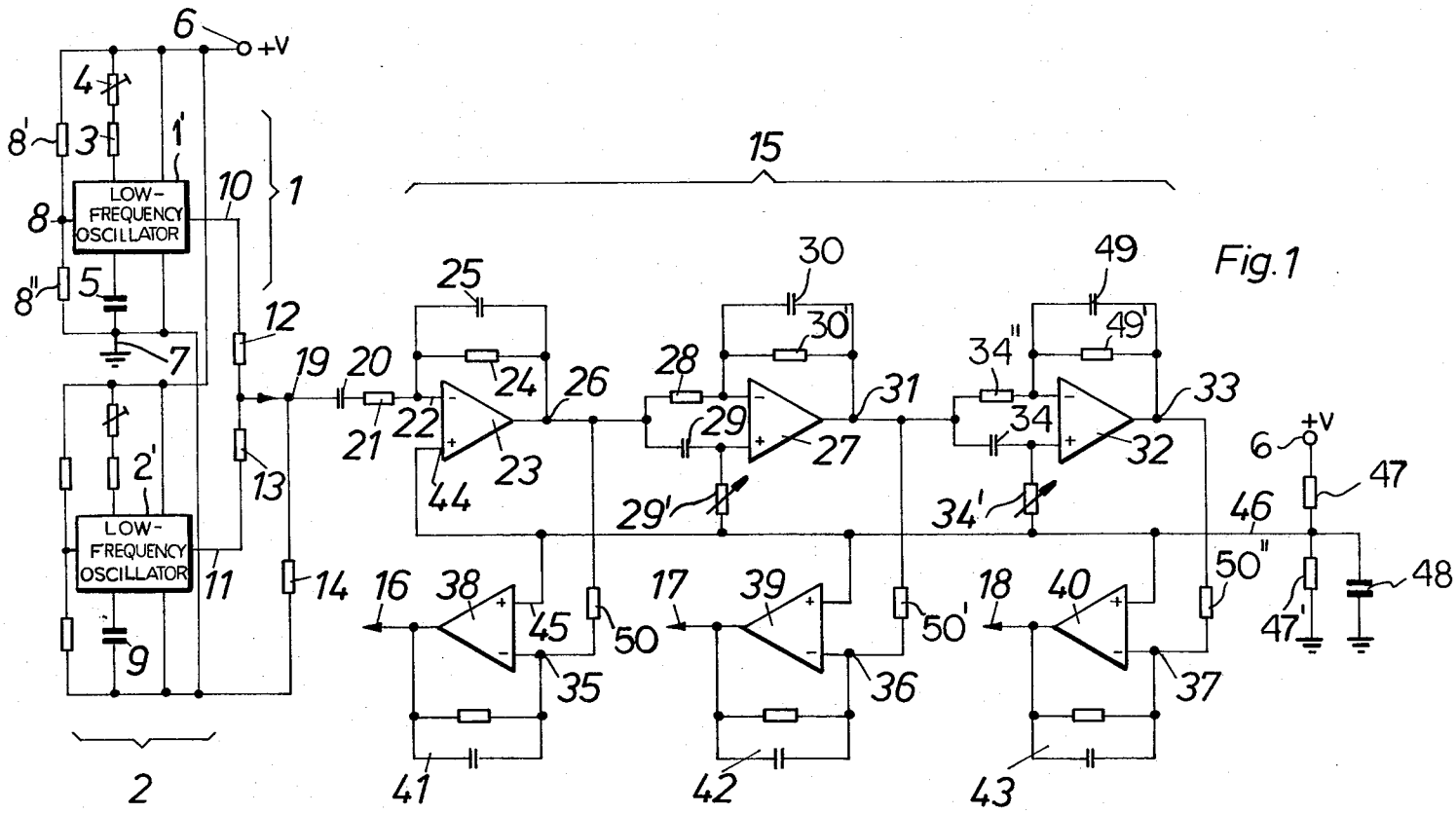
FIG. 1 is a circuit diagram of a signal converter embodying my invention, receiving sub-audio-frequency components from a pair of oscillators.
Figure 2:
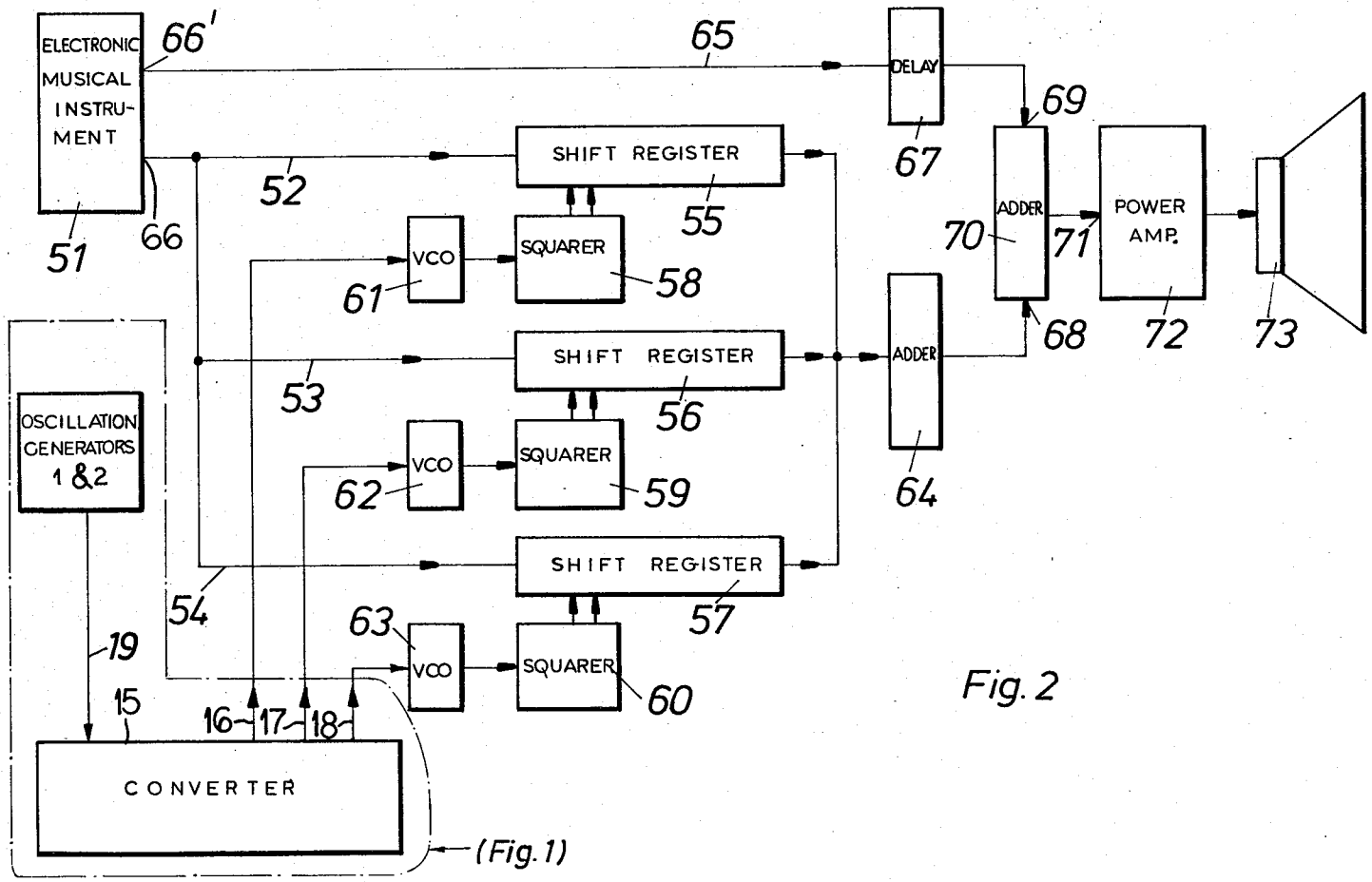
FIG. 2 is an overall block diagram of a phase-modulating system including the converter of FIG. 1.

FIGS. 1 and 2 show the combination of two generators 1 and 2 of sub-audio-frequency oscillations with a signal converter 15 designed to produce modulating voltages for three sine-wave or sawtooth oscillators 61, 62, 63 which, via respective pulse shapers or squarers 58, 59 and 60, control the transmission of audio-frequency signals from an output 66 of an electronic musical instrument 51 over three parallel channels 52, 53, 54 to a loudspeaker 73. Channels 52–54 include respective shift registers 55, 56, 57 each consisting of a multiplicity of charge-coupled stages of the bucket-brigade type integrated in a common substrate as is well known per se. Squarers 58–60 each have two outputs on which a pair of pulse trains in mutual phase opposition are fed in parallel to the odd-numbered and the even-numbered stages of the associated shift register, generally as described for the chain of field-effect transistors (MOSFETs) of the Van der Kooij patent referred to above. The three shift registers 55–57 work into a common adder 64 whose output is tied to one input 68 of another adder 70 having a second input 69 connected by way of a delay line 67 in a fourth channel 65 to a second output 66′ of instrument 51. Adder 70 jointly supplies the output signals of all four channels 52, 53, 54, 65 to an input 71 of a power amplifier 72 feeding the loudspeaker 73.

The three oscillators 61, 62 and 63, which are of the voltage-controlled type, have frequency-adjusting inputs connected to respective output terminals 16, 17 and 18 of converter 15 more fully described hereinafter. The nominal operating frequencies of these oscillators all lie above the audio range and may have respective values of 30, 55 and 80 kHz, for example. The relative number of stages of shift registers 55–57 should, of course, be proportional to their stepping frequencies so that the audio signal from instrument output 66 arrives substantially simultaneously from all three channels at adder 64; the delay of line 67 should also substantially equal that introduced by each of these registers. Nonillustrated amplifiers or attenuators in series with shift registers 55–57 could be used to vary the relative magnitudes of the signal voltages contributed by the four channels to the input of power amplifier 72.

As shown in FIG. 1, generators 1 and 2 consist essentially of respective low-frequency oscillators 1′ and 2′ which may be integrated multivibrators of great frequency stability operating, for example, at 1 Hz at 6.6 Hz, respectively. Their external circuit elements, connected between a positive terminal 6 and a grounded negative terminal 7 of a d-c power supply, include a resistive voltage divider 8′, 8″ with a tap 8 connected to chip 1′, a fixed resistor 3 in series with an adjustable resistor 4, and a capacitor 5 as particularly illustrated for generator 1; the circuitry of generator 2, including a capacitor 9, is identical but is tuned to a different sub-audio frequency assumed by way of example to be higher than that of generator 1. Outputs 10 and 11 of oscillators 1′ and 2′ are connected via respective decoupling resistors 12 and 13 to a lead 19 which is grounded by way of a common load resistor 14.

Signal converter 15 comprises three cascaded operational amplifiers 23, 27 and 32. Amplifier 23, whose non-inverting input 44 is connected over a lead 46 to positive potential +V on terminal 6 by way of a resistor 47 and is grounded for high frequencies through a capacitor 48, has an inverting input 22 connected to lead 19 via a blocking capacitor 20 and a decoupling resistor 21. A resistor 47′ in parallel with capacitor 48 forms with resistor 47 a voltage divider establishing a fixed biasing potential for lead 46.

The output 26 of amplifier 23 is connected to its inverting input 22 by a stabilizing negative-feedback circuit including a resistor 24 in parallel with a capacitor 25. Similar feedback circuits, comprising capacitors 30, 49 and resistors 30′, 49′, connect outputs 31 and 33 of amplifiers 27 and 33 to their inverting inputs.

Output 26 of amplifier 23 is further connected via a resistor 28 to the inverting input and via a capacitor 29 to the noninverting input of the next-following amplifier 27 whose output 31 is similarly connected, via a resistor 34″ and a capacitor 34, to the inverting and noninverting inputs of the last amplifier 32. Capacitors 29 and 34 lie in the series arms of respective RC networks also including shunt resistors 29′ and 34′ linking the noninverting inputs of amplifiers 27 and 32 to fixed-potential supply lead 46.

Amplifier outputs 26, 31 and 33 form junction points with three branch lines extending to inverting inputs 35, 36 and 37 of other operational amplifiers 38, 39 and 40, these lines including respective resistors 50, 50′ and 50″. Amplifiers 38–40, whose noninverting inputs are tied to supply lead 46, have outputs constituting the terminals 16–18; these outputs are coupled to their inverting inputs by way of negative-feedback circuits 41, 42, 43 with parallel resistors and capacitors, similar to those of cascaded amplifiers 23, 27 and 32.

All these negative-feedback circuits, by virtue of their parallel capacitances, preferentially pass the higher of the two sub-audio-frequency components, generated by oscillator 2, whereby this component appears more attenuated in the output of the corresponding amplifier. On the other hand, capacitors 29 and 34 discriminate against the lower one of these components, i.e. the one delivered by oscillator 1′. I prefer to make the time constants of networks 29, 29′ and 34, 34′ slightly different from each other but approximately equal to the reciprocal value of the frequency of the higher component supplied by oscillator 2′; on the other hand, circuits 41, 42, 43 preferably have mutually different time constants approximating the reciprocal of the lower component.

With suitable choice of the impedances involved, some of which may be adjustable as particularly illustrated for resistors 29′ and 34′, the lower-frequency component appears at terminals 17 and 18 with respective phase shifts of 120° and 240° relative to terminal 16; the higher-frequency component experiences smaller phase shifts with values lying between 90° and 120° at terminal 17 and between 180° and 240° at terminal 18, or with whole multiples of these values. Thus, three mutually different modulating signals in the sub-audio range are fed to the frequency-adjusting inputs of the voltage-controlled oscillators 61–63 (FIG. 2) whose own operating frequencies also differ from one another.

Figure 3:
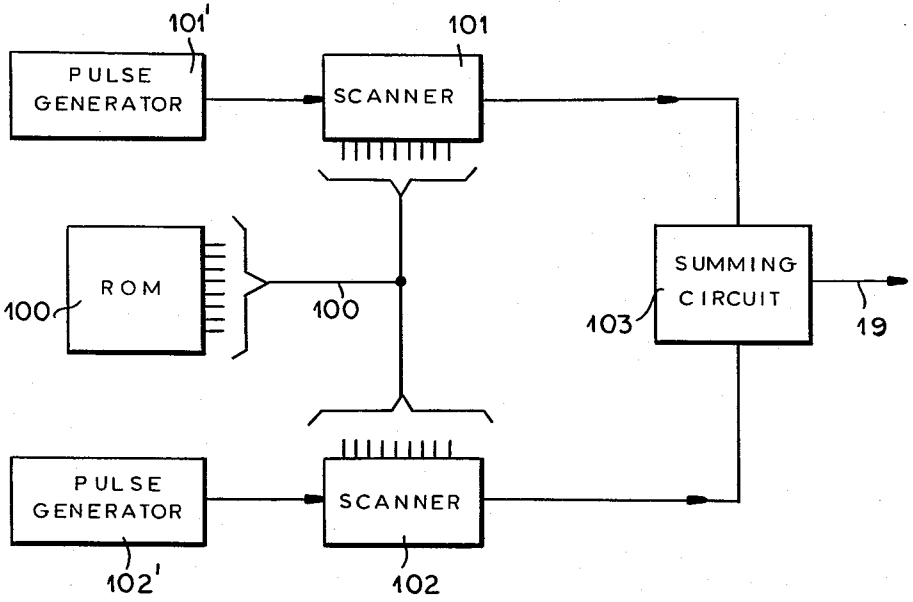
FIG. 3 is a block diagram of a waveform generator adapted to be used in lieu of the oscillators of FIG. 1.

In FIG. 3 I have shown a generator of a composite sub-audio-frequency signal which can be used in lieu of the oscillators 1 and 2 in the embodiment just described. A read-only memory 100 stores digitized amplitude values in a number of cells which are sequentially addressed by two scanners 101 and 102 connected to these cells by a multiple 100′. Scanners 101 and 102 are driven by two pulse generators 101′ and 102′, operating at different pulse rates, so as to read out recurrent stepped waveforms of the same configuration but different frequencies fed via a summing circuit 103—e.g. a forward-/backward counter—to the output 19 of FIG. 1. The two waveforms could, however, also be read out from different memories.

It will be apparent that more than two low-frequency oscillators (or scanners in FIG. 3) could be used to provide components of a composite modulating signal and that the number of parallel channels with shift registers operating at different charge-transfer rates may be smaller or larger than three, though that number affords the best combination of simplicity and versatility. The several low frequencies are preferably not harmonically related to one another; this also applies to the high operating frequencies of oscillators 61–63.

I claim:

1. In an electronic musical instrument comprising a source of audio-frequency oscillations, electroacoustic transducer means, three parallel channels connecting said source to said transducer means, shift registers in said channels stepped by respective high-frequency pulse generators with operating frequencies variable by control signals applied thereto, and modulating means connected to said pulse generators for subjecting said audio-frequency oscillations to delays varying at subaudible rates, the improvement wherein said modulating means comprises:

waveform-generating means for producing a composite periodic signal synthesized from at least two additively combined sub-audio-frequency components;

a transmission path for said composite signal including cascaded first, second and third operational amplifiers interconnected by first and second RC networks of mutually different time constants introducing respective frequency-dependent phase shifts;

a first connection extending from a junction between said first operational amplifier and said first RC network to a frequency-adjusting input of a first of said pulse generators for supplying same with a first control signal;

a second connection extending from a junction between said second operational amplifier and said second RC network to a frequency-adjusting input of a second of said pulse generators for supplying same with a second control signal differing from said first control signal; and a third connection extending from an output of said third operational amplifier to a frequency-adjusting input of a third of said pulse generators for supplying same with a third control signal differing from said first and second control signals.

2. The instrument defined in claim 1 wherein said RC networks are inserted between a noninverting input of each cascaded operational amplifier except the first one and the output of the immediately preceding operational amplifier, the output of each cascaded operational amplifier except the last one being further connected through a decoupling resistor to an inverting input of the immediately following operational amplifier.

3. The instrument defined in claim 2 wherein said RC networks favor higher-frequency components and have time constants approximately equal to the reciprocal of the frequency of the highest-frequency component of said composite signal.

4. The instrument defined in claim 1, 2 or 3 wherein said RC networks include adjustable impedances.

5. The instrument defined in claim 1, 2 or 3 wherein said first, second and third connections include inverting further operational amplifiers provided with respective frequency-dependent phase-shifting resistive/-capacitive feedback circuits of mutually different time constants.

6. The instrument defined in claim 5 wherein said feedback circuits tend to suppress lower-frequency components and have time constants approximately equal to the reciprocal of the frequency of the lowest-frequency component of said composite signal.

7. The instrument defined in claim 1 wherein said components have frequencies not harmonically related to one another.

8. The instrument defined in claim 1 or 7 wherein said waveform-generating means comprises a plurality of oscillators generating nonsinusoidal waveforms and summing means for linearly combining said waveforms.

9. The instrument defined in claim 1 or 7 wherein said waveform-generating means comprises memory means for storing a set of amplitudes of a stepped waveform, a plurality of scanning circuits connected to said memory means for cyclically reading out said amplitudes at different rates to produce respective stepped waveforms, and summing means for linearly combining said waveforms.

10. The instrument defined in claim 1, 2, 3 or 7 wherein said pulse generators comprise respective voltage-controlled oscillators, of different nominal frequencies above the frequency band of said audio-frequency oscillations, and pulse shapers inserted between said voltage-controlled oscillators and the respective shift registers.

* * * * *